US009528747B2

(12) United States Patent
Suzuki et al.

(10) Patent No.: US 9,528,747 B2
(45) Date of Patent: Dec. 27, 2016

(54) REFRIGERATOR

(71) Applicant: SAMSUNG ELECTRONICS CO., LTD., Suwon-si, Gyeonggi-do (KR)

(72) Inventors: Toshiaki Suzuki, Minoo (JP); Yasushi Soda, Minoo (JP)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/406,456

(22) PCT Filed: Jun. 7, 2013

(86) PCT No.: PCT/JP2013/003606
§ 371 (c)(1),
(2) Date: Dec. 8, 2014

(87) PCT Pub. No.: WO2013/183304
PCT Pub. Date: Dec. 12, 2013

(65) Prior Publication Data

US 2015/0145398 A1 May 28, 2015

(30) Foreign Application Priority Data

Jun. 7, 2012 (JP) ..... 2012-129596

(51) Int. Cl.
*F25D 23/00* (2006.01)
*F25D 11/00* (2006.01)
*F25D 23/06* (2006.01)

(52) U.S. Cl.
CPC ..... *F25D 23/00* (2013.01); *F25D 11/00* (2013.01); *F25D 23/065* (2013.01); *F25D 23/067* (2013.01); *F25D 2400/40* (2013.01)

(58) Field of Classification Search
CPC ..... F25D 23/06; F25D 23/061; F25D 23/062; F25D 23/065; F25D 23/066; F25D 23/067; F25D 23/08; F25D 23/082; F25D 2400/40
See application file for complete search history.

(56) References Cited

U.S. PATENT DOCUMENTS 3,346,688 A * 10/1967 Fields ..... 174/68.3
3,883,198 A * 5/1975 Tillman ..... 312/406.2
(Continued)

FOREIGN PATENT DOCUMENTS

CN 1029359 7/1995
CN 102087043 6/2011
(Continued)

OTHER PUBLICATIONS

DE102005004453A1 Machine Translation.pdf, 4 pages.*
(Continued)

*Primary Examiner* — Andrew Roersma
(74) *Attorney, Agent, or Firm* — Staas & Halsey LLP

(57) ABSTRACT

Disclosed herein is a refrigerator in which a foam insulation material is filled in a space between an inner case (11) and an outer case (12) and a wire harness (20) with a bundle of a plurality of wires (30) is embedded in the foam insulation material, wherein in the wire harness, the wires are bound and flattened in at least one position thereof by binding tools (40), at least one of the binding tools is curved or bent about an extension direction of the wires, and in a corner portion at which two surfaces of the inner case intersect, the curved or bent binding tool is attached to the inner case so as to wrap the corner portion.

18 Claims, 4 Drawing Sheets

(56) References Cited

U.S. PATENT DOCUMENTS

| | | | | | |
|---|---|---|---|---|---|
| 5,188,319 | A * | 2/1993 | Hawash | B60R 16/0215 | 248/68.1 |
| 5,401,905 | A * | 3/1995 | Lesser et al. | 174/99 R | |
| 5,632,457 | A * | 5/1997 | Neely, Jr. | 248/69 | |
| 5,828,009 | A * | 10/1998 | James et al. | 174/135 | |
| 5,937,745 | A | 8/1999 | Boe | | |
| 6,945,027 | B2 * | 9/2005 | Blase | 59/78.1 | |
| 8,048,510 | B2 * | 11/2011 | Egan et al. | 428/195.1 | |
| 2002/0088644 | A1 | 7/2002 | Burland | | |
| 2004/0135039 | A1 | 7/2004 | Reichert et al. | | |
| 2009/0058244 | A1 * | 3/2009 | Cho | F25D 23/062 | 312/401 |
| 2011/0099775 | A1 | 5/2011 | Chou et al. | | |
| 2012/0077371 | A1 | 3/2012 | Fix et al. | | |

FOREIGN PATENT DOCUMENTS

| | | | | |
|---|---|---|---|---|
| DE | 10050279 | A1 | 4/2002 | |
| DE | 102005004453 | A1 | 8/2006 | |
| DE | 1020080442515 | A1 * | 6/2010 | F25D 23/06 |
| DE | 102010039500 | A1 * | 2/2012 | F25D 23/00 |
| EP | 1174747 | A1 | 1/2002 | |
| JP | 7-222332 | | 8/1995 | |
| JP | 2006162144 | A * | 6/2006 | F25D 23/00 |
| JP | 2006-211736 | | 8/2006 | |
| JP | 2007120881 | A * | 5/2007 | F25D 23/00 |
| JP | 2012-2394 | | 1/2012 | |
| WO | WO2012059337 | A2 * | 5/2012 | F25D 23/06 |

OTHER PUBLICATIONS

CN1046415 Machine Translation.pdf, 17 pages.*

International Search Report mailed Aug. 20, 2013, in corresponding International Patent Application No. PCT/JP2013/003606.

Korean Office Action dated Nov. 17, 2015 in corresponding Korean Patent Application No. 10-2014-7034364.

Chinese Office Action dated Dec. 3, 2015 in corresponding Chinese Patent Application No. 201380029862.0.

Extended European Search Report dated Dec. 18, 2015 in corresponding European Patent Application No. 13801002.0.

Korean Decision on Grant dated Jun. 28, 2016 in corresponding Korean Patent Application No. 10-2014-7034364.

Chinese Office Action dated Jun. 28, 2016 in corresponding Chinese Patent Application No. 201380029862.0.

* cited by examiner (A)

(B)

(A) (B) (C)

REFRIGERATOR

CROSS-REFERENCE TO RELATED APPLICATION(S)

This application is a U.S. National Stage Application, which claims the benefit under 35 U.S.C. §371 of PCT International Patent Application No. PCT/JP2013/003606, filed Jun. 7, 2013, which claims the foreign priority benefit under 35 U.S.C. §119 of Japanese Patent Application No. 2012-129596, filed Jun. 7, 2012, the contents of which are incorporated herein by reference.

TECHNICAL FIELD

The present invention relates to a refrigerator, particularly to a technique to improve an internal volume ratio and heat insulation efficiency of a refrigerator.

BACKGROUND ART

In general, a cabinet of a refrigerator consists of an inner case and an outer case and a heat insulation layer is formed in a space between the inner case and the outer case. The heat insulation layer is formed by combining the inner case with the outer case and then injecting urethane foam or the like from an inlet of the outer case to foam and harden the same therein. In addition, a wire harness with a bundle of various wires is housed in the space between the inner case and outer case of the refrigerator. The wire harness is embedded in a foam insulation material in a process of forming the heat insulation layer.

In recent years, the refrigerator shows a technical tendency that a thickness of the foam insulation material becomes increasingly thinner by improvement in internal volume ratio of the refrigerator, utilization of a VIP (Vacuum Insulation Panel), etc. In addition, the number of wires tends to increase due to increase in the number of various sensors and devices in the refrigerator. For this reason, nowadays there is also a refrigerator configured such that a thickness of a foam insulation material is nearly equal to a diameter of a bundle of wires in a wire harness. Accordingly, the thickness of the foam insulation material may not be sufficiently secured at a portion at which the wire harness is present, and foaming defects, such as a void caused by inhibition of a flow channel of urethane foam, are generated. As a result, serious problems such as condensation are brought about by deterioration of heat insulation properties of the foam insulation material.

As countermeasures to the above problems, an example of using a plate-like harness assembly in which a variety of wires are interposed and adhered by sheet materials is conventionally disclosed (for instance, see Patent Document 1). In addition, an example in which grooves are provided on corner portions of an inner case and a variety of wires are housed in the grooves is disclosed (for instance, see Patent Document 2). In addition, an example in which a flat cable configured in a band shape by bonding and flattening a variety of wires is used as a wire harness is disclosed, although it is not intended to improve heat insulation efficiency of a refrigerator (for instance, see Patent Document 3).

CITATION LIST

Patent Document

Patent Document 1: Japanese Unexamined Patent Application Publication No. 5-205532

Patent Document 2: Japanese Unexamined Patent Application Publication No. 2006-162144

Patent Document 3: Japanese Unexamined Patent Application Publication No. 7-294104

DISCLOSURE

Technical Problem

The flat cable has a problem in that it is difficult to ensure electric insulation properties due to tearing of bridge portions or to automatically carry out caulking operation of terminals. In addition, overall cost is increased because a pressure connector is expensive. In addition, in the harness assembly in which a variety of wires are interposed and adhered by sheet materials, heat insulation properties are deteriorated since a foam flow portion other than necessary portions is inhibited by the sheet materials, and furthermore, overall cost is increased due to use of the sheet materials. Accordingly, it is disadvantageous to use the above manner as a wire harness. Meanwhile, a method of providing the grooves on the corner portions of the inner case and performing chamfering of the corner portions is undesirable since the inner volume ratio of the refrigerator is decreased.

Therefore, the present invention has been made in view of the above problems, and it is an object of the present invention to improve an internal volume ratio and heat insulation efficiency of a refrigerator at relatively low cost.

Technical Solution

A refrigerator in accordance with an aspect of the present invention is a refrigerator in which a foam insulation material is filled in a space between an inner case and an outer case and a wire harness with a bundle of a plurality of wires is embedded in the foam insulation material, wherein in the wire harness, the wires are bound and flattened in at least one position thereof by binding tools, at least one of the binding tools is curved or bent about an extension direction of the wires, and in a corner portion at which two surfaces of the inner case intersect, the curved or bent binding tool is attached to the inner case so as to wrap the corner portion.

In addition, the binding tools may each be made of a flexible material. Specifically, each of the binding tools may include a base portion having a flexible plate shape, a tie portion having a long shape, one end of the tie portion being integrally formed with one end of the base portion, and a hook portion provided on a surface of the base portion so as to protrude in a vertical direction in planar view, and configured to hook the tie portion in at least one position thereof such that the tie portion is freely movable in an extension direction, while suppressing the tie portion from being separated in a vertical direction of the base portion in planar view. The wires may be interposed between the base portion and the tie portion.

Advantageous Effects

In accordance with the present invention, a wire harness may be configured at low cost and at the same time foaming defects such as a void may be eliminated by sufficiently securing a flow channel of urethane foam when a heat insulation layer is formed. In addition, a plurality of wires may be arranged at a corner portion of an inner case without provision of grooves and chamfering of the corner portion.

Consequently, an internal volume ratio and heat insulation efficiency of a refrigerator may be improved at relatively low cost.

DESCRIPTION OF DRAWINGS

The above and other objects, features and other advantages of the present invention will be more clearly understood from the following detailed description taken in conjunction with the accompanying drawings, in which.

BEST MODE

Figure 1:
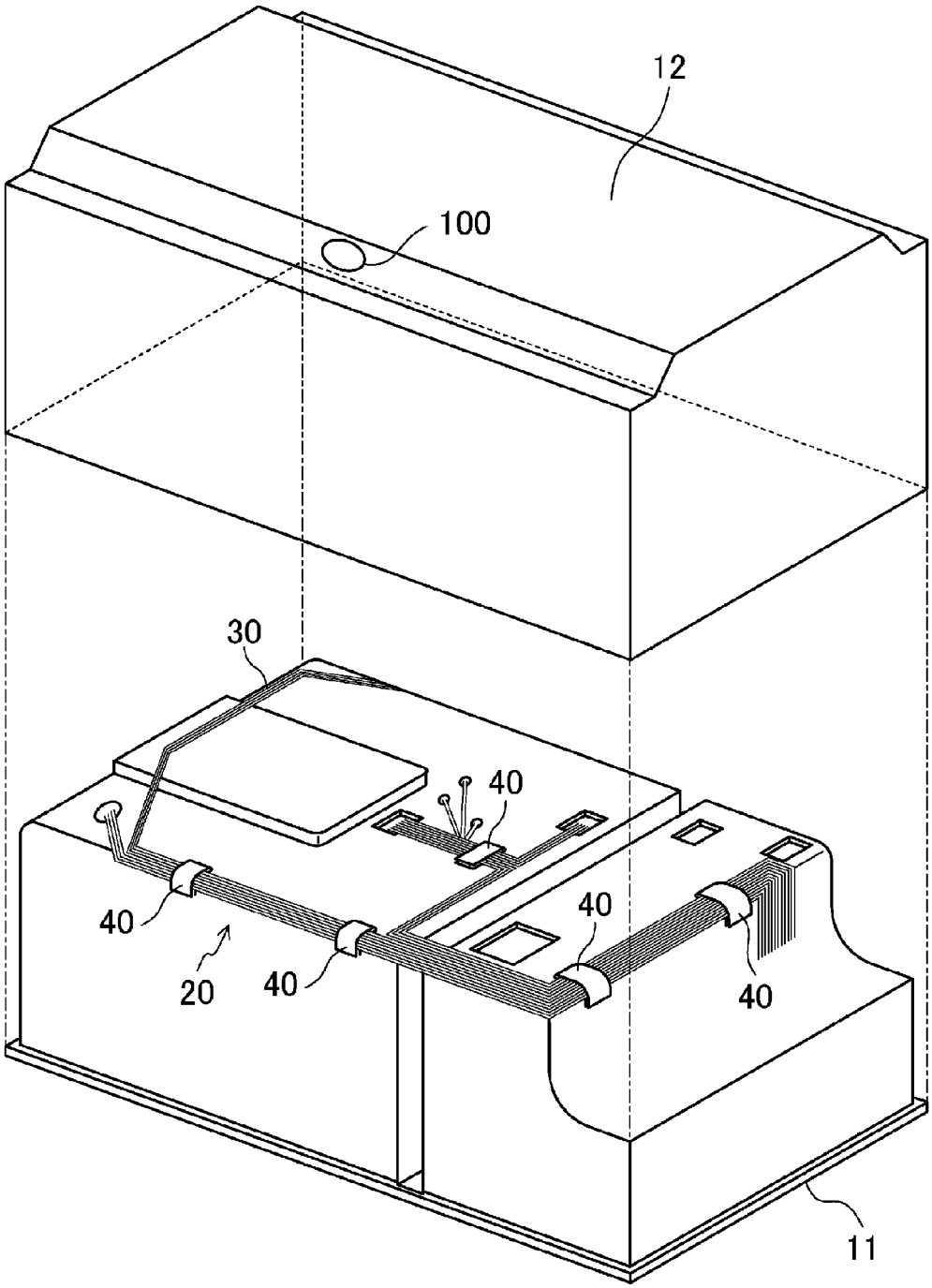
FIG. 1 is a view schematically illustrating a cabinet structure of a refrigerator according to an embodiment of the present invention.

Hereinafter, an embodiment of the present invention will be described with reference to the drawings. Throughout the disclosure, like reference numerals refer to like parts throughout the various figures and embodiment of the present invention. Moreover, the present invention is not limited to the following embodiment.

FIG. 1 schematically shows a cabinet structure of a refrigerator according to an embodiment of the present invention. A cabinet of a refrigerator consists of an inner case 11 and an outer case 12. When the inner case 11 is combined with the outer case 12, a space with a thickness of several tens of mm is defined therebetween. Urethane foam or the like is injected from an inlet 100 opened to a surface of the outer case 12 to be foamed and hardened in the space between the inner case 11 and the outer case 12, and thus a heat insulation layer is formed between the inner case 11 and the outer case 12. A VIP is also used together in order to make the heat insulation layer thinner and improve heat insulation efficiency. In this case, the VIP is typically adhered to an inner surface of the outer case 12.

A wire harness 20 is attached to the inner case 11. The wire harness 20 is embedded in a foam insulation material in the heat insulation layer. In addition, various devices are also attached to the inner case 11 besides the wire harness 20, but are not shown for convenience of description.

The wire harness 20 binds a plurality of wires 30 in at least one position thereof by an associated binding tool 40. Each wire 30 is an electric wire to supply electric power and signals to various devices and sensors (not shown), etc. The wire 30 has a variety of lengths and thicknesses. Although not shown, a terminal of each wire 30 is processed, and the proper number of plugs or connectors is attached thereto.

The number of wires 30 bound by one binding tool 40 is often several tens of wires. In the wire harness 20, a plurality of wires 30 is not bound and rounded but is bound and flattened using the binding tools 40. That is, in the wire harness 20, the wires 30 are bound and flattened in at least one position thereof by the associated binding tool 40.

Bound portions by the binding tools 40 are desirably thin, namely, as flat as possible. For example, when all thicknesses of bundles of wires 30 bound by the binding tools 40 are equal, the wires 30 are widely bound so as not to overlap each other and thus a bound portion by each binding tool 40 may be thinnest. On the other hand, when the thicknesses of the bundles of wires 30 vary, a thickness of each bound portion is determined according to a diameter of the thickest bundle of wires 30. Therefore, thin wires 30 may also be repeatedly bound.

The binding tools 40 have a straight extended shape, and a shape curved or bent about an extension direction of the wire 30. Here, the curved shape is a shape in which one binding tool 40 is curved as a whole at a relatively large curvature, and the bent shape is a shape in which a portion of one binding tool 40, for example, a central portion thereof is curved at a relatively small curvature.

The binding tools 40 having a straight extended shape are attached to a flat portion (for instance, a rear surface) of the inner case 11. On the other hand, the binding tools 40 having a curved or bent shape are attached to a corner portion, at which two surfaces (for instance, rear and side surfaces) of the inner case 11 intersect, so as to wrap the corner portion. That is, bent states of the binding tools 40 depend on the shape of the corner portion of the inner case 11 to which the binding tools 40 are attached.

Moreover, various means such as glue, adhesive by an adhesive tape, and fastening screws are used as an attachment means of each binding tool 40, but any of them may also be adopted.

Figure 2:
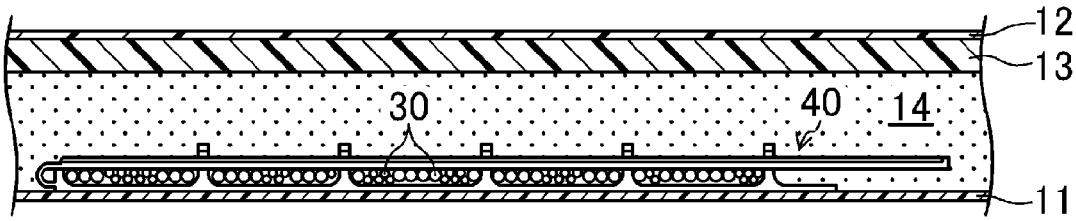
FIG. 2 is a cross-sectional view of the refrigerator according to the embodiment of the present invention.
Figure 2:
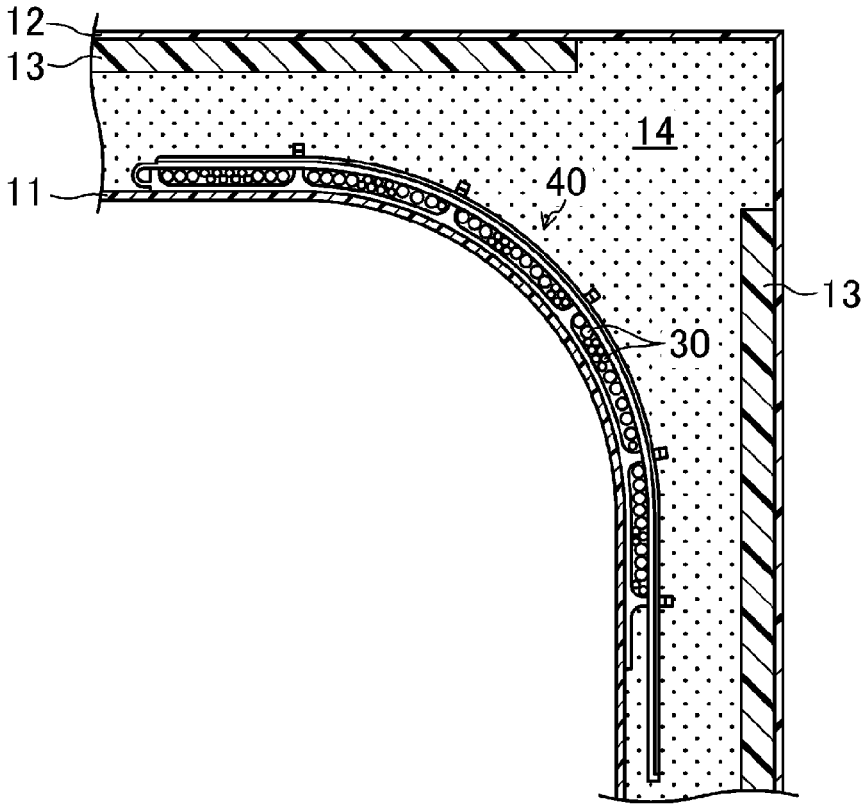

FIG. 2 shows a cross section of the refrigerator according to the embodiment of the present invention. FIG. 2(A) shows an enlarged cross section of the flat portion of the inner case 11, and FIG. 2(B) shows an enlarged cross section of the corner portion of the inner case 11. In the embodiment, a VIP 13 with a thickness of several mm is attached to an inner surface of the outer case 12 and a gap between the inner case 11 and the VIP 13 is 22 mm. In addition, the corner portion of the inner case 11 has a shape rounded at a radius of curvature with a proper size. As the wires 30, for example, AWG 26 and AWG 20 as AWG (American Wire Gauge) conversion values are mixed in plural numbers.

When the wires 30 are bound and rounded, a diameter of a bundle of wires 30 is nearly equal to a thickness of a foam insulation material 14 and a flow channel of urethane foam is inhibited during injection of the urethane foam, thereby generating a void. On the other hand, in the embodiment, the wires 30 are bound and flattened to be thinnest by the binding tools 40, and a bundle of wires 30 has a thickness of several mm. Accordingly, the urethane foam is injected into the space between the inner case 11 and the outer case 12 without inhibition of injection, and thus generation of the void may be prevented. In addition, the foam insulation material 14 may have a thickness of several tens of mm even in a position of the thinnest portion thereof, and thus heat insulation efficiency may be favorably maintained.

Each binding tool 40 may also be made of a hardened synthetic resin so as not to be easily deformable, or may also be made of a flexible material such as polyacetal or polyamide so as to be easily deformable when attached to the inner case 11. In the latter case, when the wire harness 20 is attached to the inner case 11, the binding tool 40 may be freely deformed according to the shape of an attached position. In addition, the binding tool 40 may also be formed by processing a thermoplastic resin sheet in a laminating manner.

Figure 3:
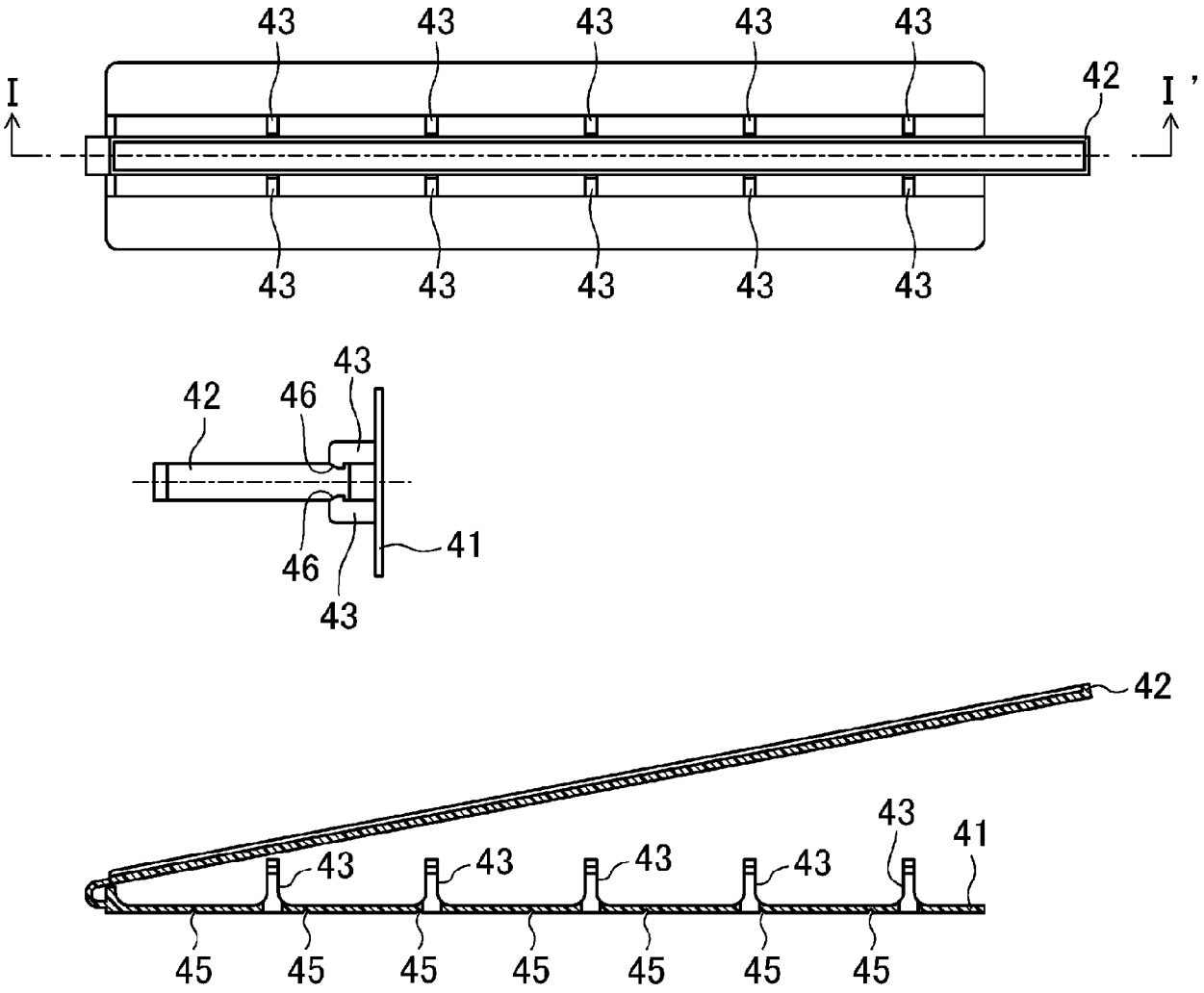
FIG. 3 is a view illustrating a configuration of a binding tool according to the embodiment.

FIG. 3 shows an example of one binding tool 40 made of a flexible material. FIG. 3(A) is a top view of the binding tool 40, FIG. 3(B) is a side view of the binding tool 40 when viewed from "I'" of FIG. 3(A), and FIG. 3(C) is a cross-sectional view taken along "I-I'" of FIG. 3(A). The binding tool 40 consists of a base portion 41, a tie portion 42, and hook portions 43. A plurality of wires (not shown) is interposed between the base portion 41 and the tie portion 42. The base portion 41 is made of a flexible material and has a plate shape. Notches 45 may also be provided on a back surface of the base portion 41 at proper intervals in order to easily bend the base portion 41. In addition, a double-sided tape may also be adhered to the back surface of the base portion 41 in order to easily attach the base portion 41 to the inner case 11.

The tie portion 42 is made of a flexible material and has a long shape. One end of the tie portion 42 is integrally formed with one end of the base portion 41.

Each hook portion 43 is provided on a surface of the base portion 41 to protrude in a vertical direction in planar view. Hooks 46 are provided at upper ends of the hook portion 43. The hooks 46 are caught by both ends of the tie portion 42 in a width direction thereof so as to suppress the tie portion 42 from being separated in the vertical direction of the base portion 41 in planar view. Thus, the wires are interposed between the base portion 41 and the tie portion 42.

In addition, the hook portion 43 serves as "partition" which prevents the wires interposed between the base portion 41 and the tie portion 42 from shifting in a longitudinal direction of the base portion 41. The hook portion 43 is configured of at least one hook portion to hook the tie portion 42 in at least one position thereof (to hook the tie portion 42 in five positions thereof in an example of FIG. 3). Therefore, the wires are partitioned into the number of proper wires and thus may be stably bound. Particularly, this is advantageous in a case in which the number of wires is small.

In addition, the tie portion 42 is configured to be slidable in an extension direction even when the tie portion 42 is hooked at the hook portion 43. That is, the tie portion 42 is configured to be freely movable in the extension direction in a state in which the wires are interposed between the base portion 41 and the tie portion 42. Consequently, the binding tool 40 may be freely bent in a state of binding the wires. This is advantageous in a case in which the binding tool 40 is bent according to the shape of a curved surface such as the corner portion of the inner case 11 to be attached to the inner case 11.

Figure 4:
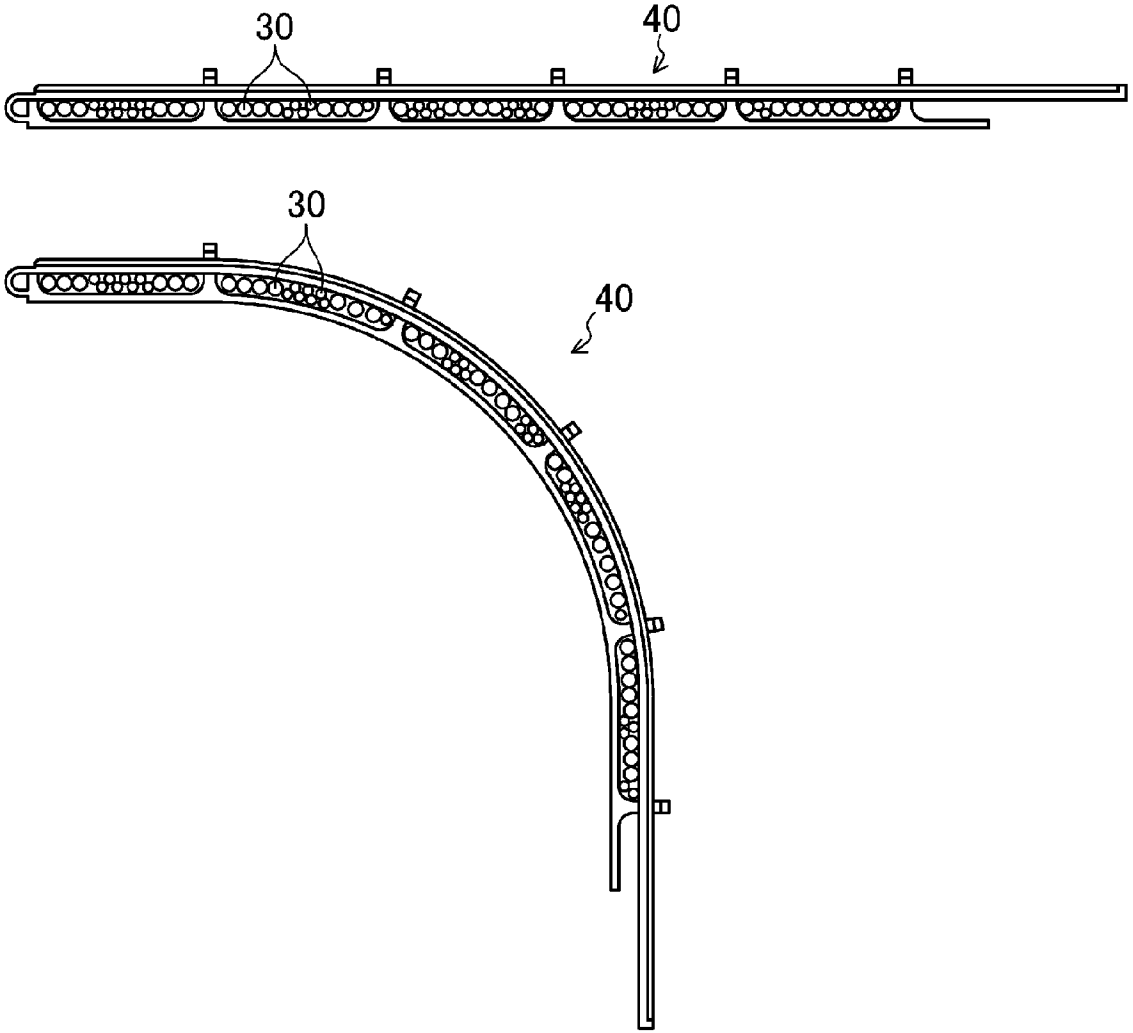
FIG. 4 is a view schematically illustrating a use state of the binding tool in FIG. 3.

FIG. 4 schematically shows a use state of the binding tool 40 in FIG. 3. FIG. 4(A) shows an example of a case in which the binding tool 40 is used in a straight extended state, and FIG. 4(B) shows an example of a case in which the binding tool 40 is used in a bent state. Regardless of the state in which the binding tool is used, the wires 30 are bound and flattened by the binding tool 40 so as not to easily shift.

In accordance with the embodiment as described above, the wire harness 20 may be configured at relatively low cost without using a specific member. In addition, since the wires 30 are bound and flattened by the binding tools 40, foaming defects such as a void may be eliminated by sufficiently securing the flow channel of urethane foam when the heat insulation layer is formed. Furthermore, the wires 30 may be arranged at the corner portion of the inner case 12 without provision of grooves and chamfering of the corner portion. Accordingly, according to the embodiment, the internal volume ratio and heat insulation efficiency of the refrigerator may be improved at relatively low cost.

Various embodiments have been described in the best mode for carrying out the invention. Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

In a refrigerator according to the present invention, since an internal volume ratio and heat insulation efficiency of the refrigerator may be improved at relatively low cost, the refrigerator is useful as a refrigerator for home and business, a freezer, or the like.

REFERENCE SIGNS LIST

11: inner case
12: outer case
14: foam insulation material
20: urethane foam
30: wire
40: binding tool
41: base portion
42: tie portion
43: hook portion

The invention claimed is:

1. A refrigerator comprising:
an inner case and an outer case configured to form a cabinet;
a wire harness formed by a plurality of wires that are bound together, which is interposed between the inner case and the outer case; and
at least one binding tool which binds the plurality of wires so that the plurality of wires are disposed in a flat manner with respect to an outer surface of the inner case and the plurality of wires are in contact with the outer surface of the inner case,
wherein the at least one binding tool comprises:
a base portion configured to attach to the outer surface of the inner case;
a tie portion disposed near the base portion to be spaced apart from the base portion; and
a plurality of hook portions each protruding from a first side of the base portion in pairs across from each other and each pair of hook portions located across from each other are configured to hook the tie portion, the pairs of hook portions located across from each other each including hooks which face each other to engage the tie portion,
wherein the tie portion extends from one end of the base portion to be integrally formed with the base portion, and the tie portion and the base portion are deformed to be in shapes corresponding to each other such that the plurality of wires are interposed between the tie portion and the first side of the base portion.

2. The refrigerator according to claim 1, wherein the at least one binding tool is provided to be bent with respect to an extension direction of the plurality of wires as an axis.

3. The refrigerator of claim 1, wherein the inner case comprises a corner portion of which an outer surface is formed to be bent, and the at least one binding tool is provided to correspond to an outer surface of the corner portion.

4. The refrigerator of claim 3, wherein the at least one binding tool is in contact with the outer surface of the corner portion with no space therebetween.

5. The refrigerator of claim 1, wherein the base portion is in contact with the outer surface of the case with no space therebetween.

6. The refrigerator of claim 5, wherein the base portion and the tie portion are provided in parallel with each other.

7. The refrigerator of claim 5, wherein the base portion comprises a flexible material, and is deformable corresponding to a shape of a portion in which the base portion is in contact with the outer surface of the inner case.

8. The refrigerator of claim 1, wherein the plurality of one hook portions are restricted from separating in a longitudinal direction of or perpendicular direction to the tie portion in a state in which the tie portion is movable in the longitudinal direction of the tie portion.

9. The refrigerator of claim 1, wherein the at least one hook portion divides a space formed by the base portion and the tie portion so that the plurality of wires are divided and bound.

10. The refrigerator of claim 1, wherein the binding tool comprises a flexible material.

11. The refrigerator of claim 1, wherein the wire harness is embedded between the inner case and the outer case along with an insulation material which foams between the inner case and the outer case.

12. The refrigerator of claim 1, wherein the plurality of wires are disposed in a space between the base portion, an end hook portion, and the tie portion.

13. The refrigerator of claim 1, wherein the hooks, of the pair of hook portions located across from each other, which face each other are configured to hook the tie portion on opposite sides of the tie portion.

14. A refrigerator comprising:

an inner case and an outer case configured to form a cabinet;

an insulation material filled between the inner case and the outer case;

a wire harness formed by a plurality of wires being bound together, and embedded between the inner case and the outer case along with the insulation material;

at least one binding tool comprising a base portion to attach to an outer surface of the inner case;

a tie portion disposed near the base portion to be spaced apart from the base portion; and a plurality of hook portions each protruding from a first side of the base portion in pairs across from each other and each pair of hook portions located across from each other are configured to hook the tie portion, the pairs of hook portions located across from each other each including hooks which face each other to engage the tie portion, wherein the tie portion extends from one end of the base portion to be integrally formed with the base portion, and the tie portion and the base portion are deformed to be in shapes corresponding to each other such that the plurality of wires are interposed between the tie portion and the first side of the base portion, and wherein the base portion comprises a flexible material that is deformable to a shape corresponding to both of a curved surface and a flat surface formed on the outer surface of the inner case and provided to be in close contact with the outer surface of the inner case.

15. The refrigerator of claim 14, wherein the at least one binding tool which binds the plurality of wires in a flattening manner, and the at least one binding tool is provided to be curved or bent with respect to an extension direction of the plurality of wires as an axis.

16. The refrigerator of claim 15, wherein the inner case comprises a corner portion in which two surfaces meet, and the at least one binding tool is curved or bent and is attached to the inner case to surround the corner portion.

17. The refrigerator of claim 15, wherein the base portion which is flexible and has a plate shape; and the tie portion having a long shape and having one end integrally formed with one end of the base portion a hook portion of the plurality of hook portions provided on a surface of the base portion vertically protruding from a flat surface of the base portion, and configured to hook at least one side of the tie portion so that the tie portion is freely movable in an extension direction, while suppressing the tie portion from being vertically separated from the base portion.

18. The refrigerator of claim 17, wherein the at least one binding tool is configured to have the plurality of wires being interposed between the base portion, the plurality of hook portions, and the tie portion.

* * * * *